US008430591B1

(12) United States Patent
Okamoto et al.

(10) Patent No.: US 8,430,591 B1
(45) Date of Patent: Apr. 30, 2013

(54) BALLPOINT PEN TIP AND BALLPOINT PEN

(75) Inventors: Keishi Okamoto, Hiroshima (JP); Satoru Ando, Hiroshima (JP); Tatsuyuki Nakatani, Hiroshima (JP); Yuki Nitta, Hiroshima (JP); Kunihiro Toyota, Kanagwa (JP); Kouichi Takayama, Kanagawa (JP); Takumi Kajiwara, Kanagawa (JP); Hirotaka Masuda, Kanagawa (JP)

(73) Assignee: Kabushiki Kaisha Pilot Corporation, Tokyo (JP)

( * ) Notice: Subject to any disclaimer, the term of this patent is extended or adjusted under 35 U.S.C. 154(b) by 0 days.

(21) Appl. No.: 13/402,788

(22) Filed: Feb. 22, 2012

(51) Int. Cl.
*B43K 7/10* (2006.01)

(52) U.S. Cl.
USPC ..... 401/215; 401/216

(58) Field of Classification Search ..... 401/208, 401/209, 212, 215, 216; 428/408
See application file for complete search history.

(56) References Cited

U.S. PATENT DOCUMENTS

| | | | | |
|---|---|---|---|---|
| 5,498,281 | A * | 3/1996 | Idogawa et al. | 106/31.9 |
| 6,815,067 | B2 * | 11/2004 | Ata et al. | 428/408 |
| 7,390,138 | B2 * | 6/2008 | Kambayashi | 401/209 |
| 2006/0246218 | A1 | 11/2006 | Bienkiewicz et al. | |
| 2007/0104399 | A1 | 5/2007 | Hamza et al. | |

FOREIGN PATENT DOCUMENTS

| | | | |
|---|---|---|---|
| JP | 3-133698 | A | 6/1991 |
| JP | 2004-338134 | A | 12/2004 |

OTHER PUBLICATIONS

Search Report dated mailed Jul. 9, 2012 in corresponding European Patent Application No. 12001175.4.

* cited by examiner

*Primary Examiner* — David Walczak
(74) *Attorney, Agent, or Firm* — Knobbe Martens Olson & Bear LLP

(57) ABSTRACT

A ballpoint pen tip includes a ball and a ball holder for rotatably holding the ball. The ball includes a ball body and a first carbonaceous film formed so as to cover a surface of the ball body. The first carbonaceous film has carbon atoms and oxygen atoms bonded to some of the carbon atoms. The ratio of carbon atoms bonded to oxygen atoms to the total carbon atoms at a surface of the first carbonaceous film is equal to or greater than 0.1.

12 Claims, 12 Drawing Sheets

| | C-C + C-H | $CO_{total}$ (C-O C=O O=C-O) | $sp^3C-C / sp^2C-C$ |
|---|---|---|---|
| DLC-1 | 0.84 | 0.16 (0.13 0.02 0.01) | 0.39 |
| DLC-2 | 0.57 | 0.43 (0.21 0.13 0.09) | 0.42 |

FIG.15

| No. | BALL DIAMETER | Ra(nm) | RESULTS OF DURABILITY EVALUATION TEST (ABRASION) |
|---|---|---|---|
| 1 | 0.5 | 1.88 | ◎ |
| 2 | 0.5 | 2.23 | ◎ |
| 3 | 0.5 | 1.98 | ◎ |
| 4 | 0.5 | 2.05 | ◎ |
| 5 | 0.5 | 2.93 | ◎ |
| 6 | 0.5 | 4.66 | ○ |
| 7 | 0.5 | 4.61 | ○ |
| 8 | 0.5 | 4.36 | ○ |
| 9 | 0.5 | 4.26 | ○ |
| 10 | 0.5 | 4.17 | ○ |

FIG.16

| No. | BALL DIAMETER | Ra(nm) | RESULTS OF DURABILITY EVALUATION TEST (ABRASION) |
|---|---|---|---|
| 1 | 0.7 | 1.50 | ◎ |
| 2 | 0.7 | 2.66 | ◎ |
| 3 | 0.7 | 2.71 | ◎ |
| 4 | 0.7 | 1.62 | ◎ |
| 5 | 0.7 | 1.88 | ◎ |
| 6 | 0.7 | 4.79 | ○ |
| 7 | 0.7 | 4.58 | ○ |
| 8 | 0.7 | 4.86 | ○ |
| 9 | 0.7 | 4.84 | ○ |
| 10 | 0.7 | 4.99 | ○ |

FIG.17

| No. | BALL DIAMETER | Ra(nm) | RESULTS OF DURABILITY EVALUATION TEST (ABRASION) |
|---|---|---|---|
| 1 | 0. 5 | 1. 34 | ◎ |
| 2 | 0. 5 | 2. 31 | ◎ |
| 3 | 0. 5 | 1. 37 | ◎ |
| 4 | 0. 5 | 2. 81 | ◎ |
| 5 | 0. 5 | 1. 32 | ◎ |
| 6 | 0. 5 | 4. 44 | ○ |
| 7 | 0. 5 | 4. 09 | ○ |
| 8 | 0. 5 | 3. 92 | ○ |
| 9 | 0. 5 | 3. 78 | ○ |
| 10 | 0. 5 | 3. 67 | ○ |

FIG.18

| No. | BALL DIAMETER | Ra(nm) | RESULTS OF DURABILITY EVALUATION TEST (ABRASION) |
|---|---|---|---|
| 1 | 0. 7 | 1. 75 | ◎ |
| 2 | 0. 7 | 2. 69 | ◎ |
| 3 | 0. 7 | 1. 57 | ◎ |
| 4 | 0. 7 | 1. 52 | ◎ |
| 5 | 0. 7 | 2. 50 | ◎ |
| 6 | 0. 7 | 4. 58 | ○ |
| 7 | 0. 7 | 4. 56 | ○ |
| 8 | 0. 7 | 4. 79 | ○ |
| 9 | 0. 7 | 4. 85 | ○ |
| 10 | 0. 7 | 4. 66 | ○ |

BALLPOINT PEN TIP AND BALLPOINT PEN

CROSS-REFERENCE TO RELATED APPLICATION

This application is related to Japanese Patent Application No. 2010-201760 filed on Sep. 9, 2010, the disclosure of which, including the specification, the drawings, and the claims is hereby incorporated by reference in its entirety.

BACKGROUND

The present disclosure relates to a ballpoint pen tip and a ballpoint pen, and particularly relates to a ballpoint pen tip including a ball coated with a carbonaceous film and a ballpoint pen.

A spherical ballpoint pen ball (hereinafter simply referred to as a "ball") is attached to a tip end of a ballpoint pen used as writing utensils. For writing, ink flowing out from an ink storage pipe is transferred to a recording medium such as paper or penetrates the recording medium by rotation of the ball. When the ball and a ball holder for holding the ball are abraded, the ball does not smoothly rotate, resulting in significant degradation of writing characteristics. Finally, the ballpoint pen can be no longer used for writing. Thus, it is important to reduce the abrasion of the ball and the ball holder.

In order to reduce the abrasion of the ball, attempts have been made by, e.g., using a ceramic ball or coating a metal ball with a hard material. In addition, in order to reduce the abrasion of the ball holder by the ball, attempts have been made by coating not only the ball but also the ball holder with a hard material (see, e.g., Japanese Patent Publication No. 2004-338134).

SUMMARY

However, even if the hardness of the ball and the ball holder is increased, it is still difficult to reduce the abrasion of the ball and the ball holder. In order to reduce the abrasion of the ball and the ball holder, it is important that a moderate amount of ink is present at an interface between the ball and the ball holder, and that the ball and the ball holder do not directly contact each other. If affinity between a ball surface and ink is low, the ball repels the ink at the surface thereof, and therefore the ink cannot be held at the interface between the ball and the ball holder. For coating of a conventional ball and a conventional ball holder, the affinity for ink is not taken into consideration. For the foregoing reason, there is a problem that the ball and the ball holder directly contact each other and, as a result, are severely abraded.

It is an objective of the present disclosure to solve the foregoing problem and to realize a ballpoint pen tip in which abrasion of a ball and a ball holder is less likely to occur and good writing characteristics are exhibited for a long period of time.

In order to accomplish the foregoing objective, a ballpoint pen tip is configured in the present disclosure such that a carbonaceous film having carbon-oxygen bonds is formed on at least one of a ball holder or a ball.

Specifically, a ballpoint pen tip of a first aspect of the present disclosure includes a ball including a ball body and a carbonaceous film covering a surface of the ball body; and a ball holder configured to rotatably hold the ball. The carbonaceous film has carbon atoms and oxygen atoms bonded to some of the carbon atoms, and a ratio of carbon atoms bonded to oxygen atoms to a total carbon atoms at a surface of the carbonaceous film is equal to or greater than 0.1.

In the ballpoint pen tip of the first aspect of the present disclosure, the ratio of carbon atoms bonded to oxygen atoms in the carbonaceous film covering the surface of the ball body is equal to or greater than 0.1. The ball has high hardness and high affinity for ink at a surface thereof. Thus, a moderate amount of ink can be held between the ball and the ball holder, and abrasion due to direct contact between the ball and the ball holder can be reduced. As a result, the ballpoint pen tip can be realized, in which degradation of writing characteristics is less likely to occur for a long period of time.

In the ballpoint pen tip of the first aspect of the present disclosure, the carbonaceous film may have a zeta potential of equal to or less than −25 mV at the surface thereof. This allows the ball to have sufficient hydrophilic properties at the surface thereof.

In the ballpoint pen tip of the first aspect of the present disclosure, a ratio of $sp^3$-carbon-carbon bonds to $sp^2$-carbon-carbon bonds in the carbonaceous film may be equal to or greater than 0.3. This ensures sufficient hardness.

In the ballpoint pen tip of the first aspect of the present disclosure, the ball may include an intermediate layer formed between the ball body and the carbonaceous film, and the intermediate layer may contain carbon and silicon.

In the ballpoint pen tip of the first aspect of the present disclosure, an arithmetic average roughness at the surface of the ball body may be equal to or less than 3 nm.

In the ballpoint pen tip of the first aspect of the present disclosure, the ball holder may include a carbonaceous film covering at least part of the ball holder contacting the ball. This further reduces abrasion of the ball holder.

A ballpoint pen tip of a second aspect of the present disclosure includes a ball and a ball holder configured to rotatably hold the ball. The ball holder includes a carbonaceous film covering at least part of the ball holder contacting the ball. The carbonaceous film contains carbon atoms and oxygen atoms bonded to some of the carbon atoms. A ratio of carbon atoms bonded to oxygen atoms to a total carbon atoms at a surface of the carbonaceous film is equal to or greater than 0.1.

In the ballpoint pen tip of the second aspect of the present disclosure, the carbonaceous film may have a zeta potential of equal to or less than −25 mV at the surface thereof. This allows the ball to have sufficient hydrophilic properties at the surface thereof.

In the ballpoint pen tip of the second aspect of the present disclosure, a ratio of $sp^3$-carbon-carbon bonds to $sp^2$-carbon-carbon bonds in the carbonaceous film may be equal to or greater than 0.3. This ensures sufficient hardness.

In the ballpoint pen tip of the second aspect of the present disclosure, the carbonaceous film may be formed on a surface of the ball holder with an intermediate layer being interposed therebetween, and the intermediate layer may contain carbon and silicon.

A ballpoint pen of the present disclosure includes the ballpoint pen tip of any one of claims 1-10; and an ink storage pipe filled with ink. A contact angle of the ink with the carbonaceous film is equal to or less than 55°. This allows ink to spread over the entirety of the surface of the ball, and therefore it is less likely that the ball and the ball holder directly contact each other.

According to the ballpoint pen tip of the present disclosure, the ballpoint pen tip can be realized, in which the abrasion of the ball and the ball holder is less likely to occur and good writing characteristics are exhibited for a long period of time.

BRIEF DESCRIPTION OF THE DRAWINGS

FIG. 15 illustrates results of the durability evaluation test when a carbonaceous film is formed on each of ball bodies having different surface roughness values.

FIG. 16 illustrates results of the durability evaluation test when a carbonaceous film is formed on each of ball bodies having different surface roughness values.

FIGS. 17 and 18 illustrates results of the durability evaluation test when a carbonaceous film is formed on each of ball bodies having different surface roughness values.

DETAILED DESCRIPTION

Figure 1:
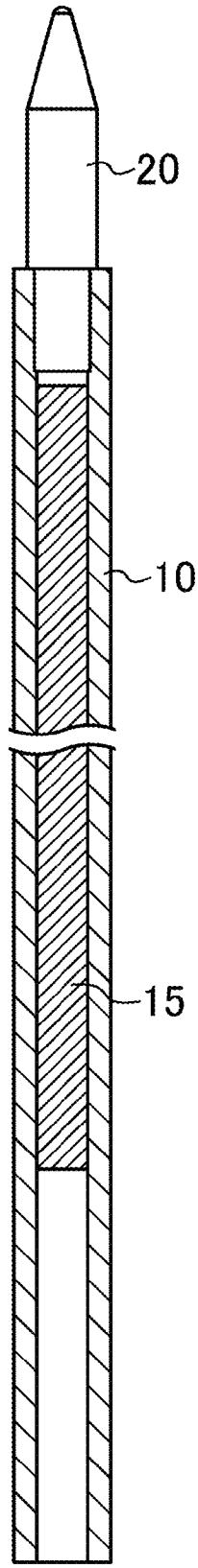
FIG. 1 is a cross-sectional view illustrating a ballpoint pen of an embodiment.

As illustrated in FIG. 1, a ballpoint pen of an embodiment includes an ink storage pipe 10 for storing ink 15, and a ballpoint pen tip 20 attached to a tip end of the ink storage pipe 10. The ink storage pipe 10 and the ballpoint pen tip 20 may be directly connected together, or may be connected together through a connection member (not shown in the figure). In general, a case (not shown in the figure) for accommodating a ballpoint pen refill including the ink storage pipe 10 and the ballpoint pen tip 20 is provided. However, the ink storage pipe 10 may serve as the case.

Figure 2:
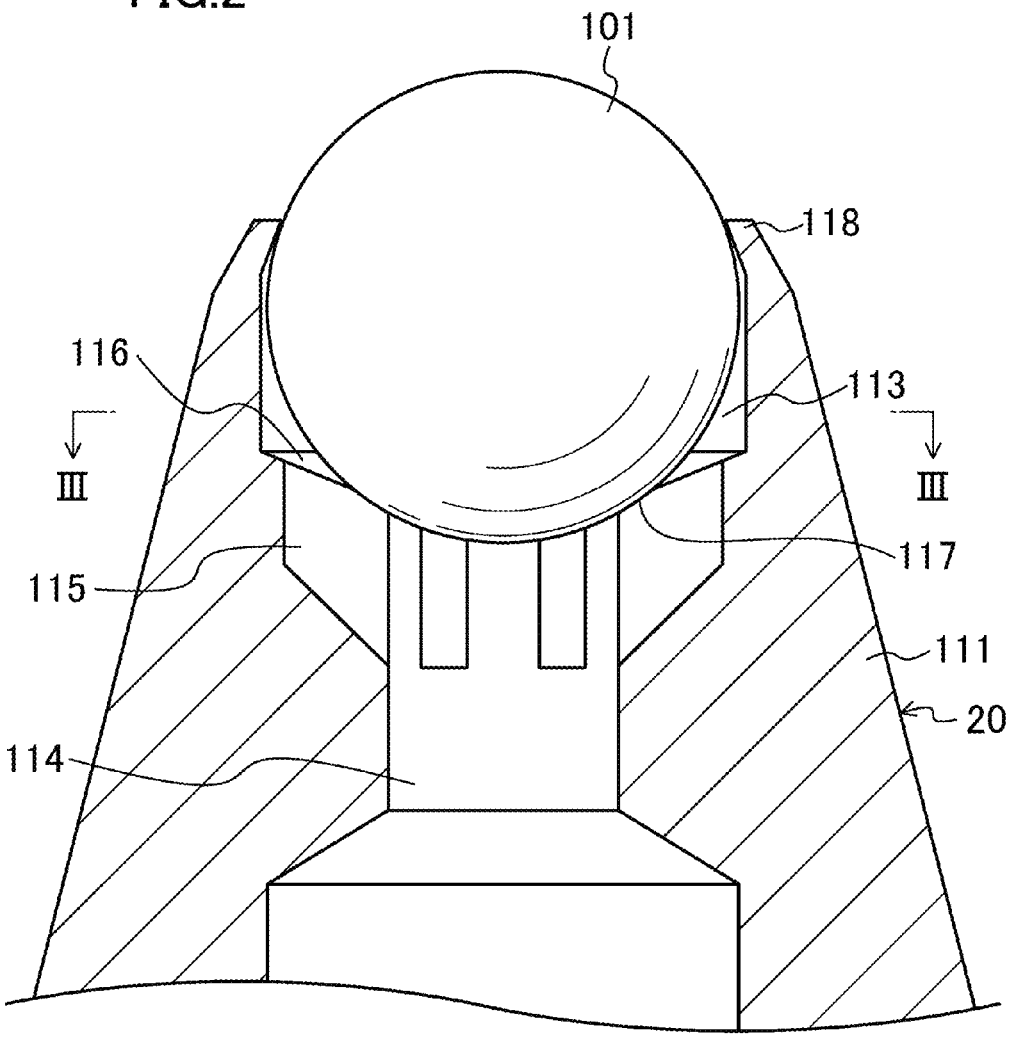
FIG. 2 is a cross-sectional view illustrating a main part of a ballpoint pen tip of the embodiment.

As illustrated in FIG. 2, the ballpoint pen tip 20 includes a ball 101 and a ball holder 111 for holding the ball 101. The ball holder 111 is made of a material such as ferrite stainless steel, and includes a ball holding chamber 113 for holding the ball 101 and an ink path 114 to which ink is supplied. The ball holding chamber 113 is a recess formed in a tip end part of the ball holder 111, and the ball 101 is rotatably held by a tip end edge part 118 and a bottom surface 116 of the ball holding chamber 113. The tip end edge part 118 is inwardly crimped (i.e., crimped in a direction toward the center of the ball 101) at a predetermined crimp angle. Thus, the ball 101 is rotatably held such that part of the ball 101 protrudes beyond the tip end edge part 118, and detachment of the ball 101 from the ball holding chamber 113 is prevented.

Figure 3:
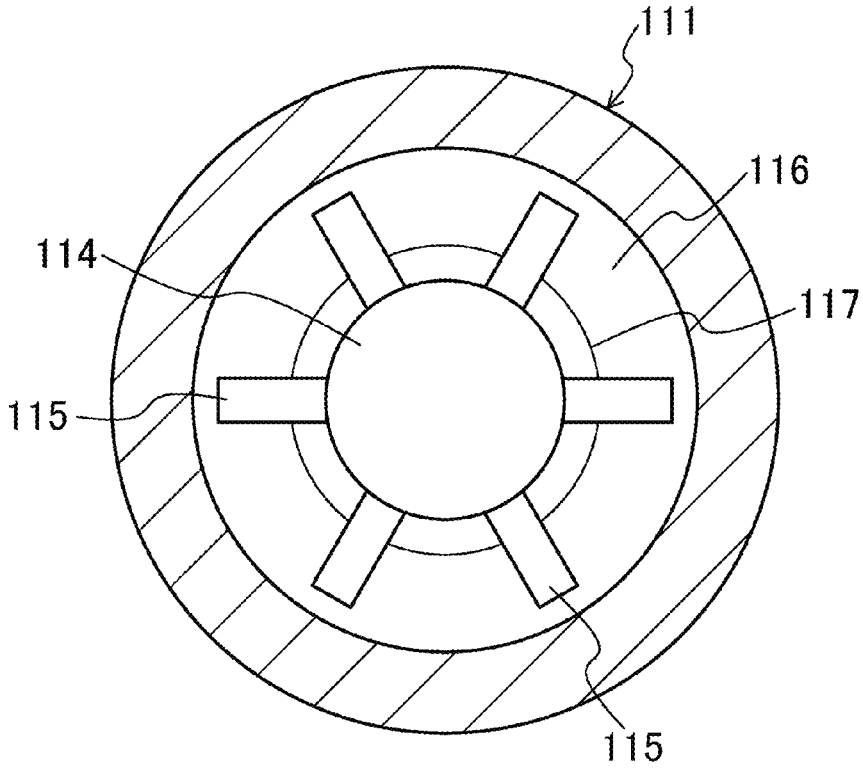
FIG. 3 is a cross-sectional view of the ball holder along an line of FIG. 2.

FIG. 3 is a cross-sectional view of the ball holder 111 along an line of FIG. 2. The ball 101 is not shown in FIG. 3. The ink path 114 is provided at the center of the bottom surface 116 of the ball holding chamber 113, and serves as a main path when ink stored in the ink storage pipe 10 flows into the ball holding chamber 113 upon writing. A plurality of grooves 115 each having a predetermined width and radially provided at predetermined intervals are formed around the ink path 114. Upon the writing, ink passing through the ink path 114 is supplied to the ball holding chamber 113 through the grooves 115. A ball seat 117 is provided so as to surround the ink path 114 in the bottom surface 116. The ball seat 117 is provided to reduce abrasion of the bottom surface 116 of the ball holding chamber 113 contacting the ball 101 upon the writing, and is formed in the same spherical shape as that of the ball 101.

Figure 4:
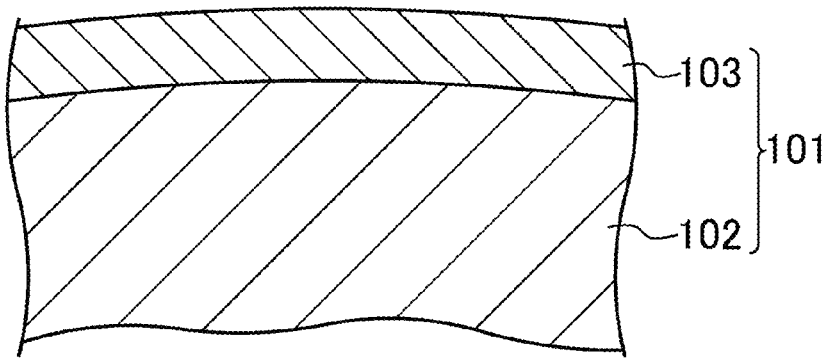
FIG. 4 is a cross-sectional view illustrating part of a ball of the ballpoint pen tip of the embodiment.

As illustrated in FIG. 4, the ball 101 includes a ball body 102 and a carbonaceous film 103 formed on the ball body 102. The material of the ball body 102 is not limited, but may be, e.g., a single-component metal, an alloy of various metals, or ceramics. Specifically, a single-component metal of, e.g., steel, copper, aluminum, or nickel may be used, or an alloy such as nickel silver or stainless steel may be used. Alternatively, e.g., metal carbide, metal oxide, metal nitride, metal boride, or metal silicide may be used. The following may be used as the carbide: titanium carbide, vanadium carbide, chromium carbide, tantalum carbide, niobium carbide, molybdenum carbide, boron carbide, zircon carbide, tungsten carbide, or silicon carbide. The following may be used as the oxide: aluminum oxide, chromium oxide, magnesium oxide, silicon oxide, beryllium oxide, thorium oxide, titanium oxide, calcium oxide, or zircon oxide. The following may be used as the nitride: titanium nitride, boron nitride, silicon nitride, or aluminum nitride. The following may be used as the boride: zircon boride, chromium boride, or titanium boride. The following may be used as the silicide: molybdenum silicide, titanium silicide, or chromium silicide. Alternatively, a composite material of metal and ceramic, such as cermet, may be used. The diameter of the ball body 102 is not limited, but is typically about 0.25-2.0 mm.

The carbonaceous film 103 is a film having $sp^2$ carbon-carbon bonds (graphite bonds) and $sp^3$carbon-carbon bonds (diamond bonds) as typified by a diamond-like film (DLC film). The carbonaceous film 103 may be a film in an amorphous state, such as the DLC film, or may be a film in a crystal state, such as a diamond film. Although the film typically has $sp^2$ carbon-hydrogen bonds and $sp^3$ carbon-hydrogen bonds, the carbon-hydrogen bond is not essential. For example, silicon (Si) or fluorine (F) may added. The carbonaceous film 103 of the present embodiment has at least carbon-oxygen bonds at the surface thereof in order to improve affinity between the ball 101 and ink. A ratio of carbon atoms forming the carbon-oxygen bonds to the total carbon atoms at the surface of the carbonaceous film 103 is preferably equal to or greater than 0.1. The ratio of the carbon atoms in the carbon-oxygen bonds will be described later in detail.

The carbonaceous film 103 may be formed by, e.g., plasma chemical vapor deposition (plasma CVD method) or catalytic chemical vapor deposition (CAT-CVD method) using hydrocarbon gas as a raw material. Alternatively, the carbonaceous film 103 may be formed by, e.g., sputtering or arc ion plating using solid graphite as a raw material. As another alternative, the carbonaceous film 103 may be formed by other method or a combination of a plurality of methods.

The carbon-oxygen bonds at the surface of the carbonaceous film 103 may be formed in such a manner that the carbonaceous film 103 is irradiated with, e.g., oxygen plasma or plasma of gas containing oxygen. As the gas containing oxygen, e.g., water vapor or air may be used. Alternatively, e.g., gas of an organic compound containing oxygen atoms may be used. As another alternative, the carbonaceous film 103 may be irradiated with ultraviolet light in atmosphere containing oxygen or may be dipped in an oxidizing solution. As still another alternative, when the carbonaceous film 103 is formed, an oxygen concentration in atmosphere may be increased, thereby forming the carbon-oxygen bonds. There are dangling bonds at the surface of the carbonaceous film 103 right after the carbonaceous film 103 is formed. Thus, in such a manner that, right after the carbonaceous film 103 is formed, the carbonaceous film 103 is exposed to atmosphere containing oxygen and then the dangling bonds and oxygen react with each other, the carbon-oxygen bonds may be formed.

Figure 5:
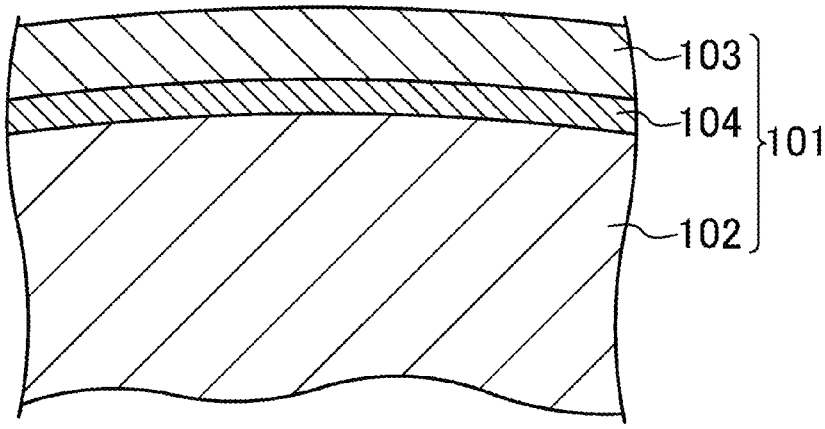
FIG. 5 is a cross-sectional view illustrating part of a variation of the ball of the ballpoint pen tip of the embodiment.

The thickness of the carbonaceous film 103 is preferably within a range of 0.001-3 μm, and more preferably within a range of 0.005-1 μm. Although the carbonaceous film 103 can be formed directly on a surface of the ball body 102, an intermediate layer 105 may be, as illustrated in FIG. 5, provided between the ball body 102 and the carbonaceous film 103 in order to more closely contact the carbonaceous film 103 to the ball body 102. As the material of the intermediate layer 105, various materials may be used depending on the types of the ball body 102, and, e.g., the following films may be used: an amorphous film made of silicon (Si) and carbon (C), an amorphous film made of titanium (Ti) and carbon (C), or an amorphous film made of chromium (Cr) and carbon (C). The thickness of the intermediate layer 105 is not limited. However, the thickness of the intermediate layer 105 is preferably within a range of 0.001-0.3 μm, and more preferably within a range of 0.005-0.1 μm. The intermediate layer 105 may be formed by using, e.g., the sputtering, a CVD method, the plasma CVD method, spraying, ion plating, or the arc ion plating.

In the ballpoint pen tip of the present embodiment, the ball 101 includes the carbonaceous film 103 formed on the surface of the ball body 102 and having the carbon-oxygen bonds. The ball 101 has not only high durability but also high affinity for ink. Thus, ink is held at an interface between the ball 101 and the ball holder 111, and it is less likely that the ball 101 and an inner circumferential surface of the ball holder 111 directly contact each other. Consequently, the abrasion of the ball 101 and the ball holder 111 due to the direct contact between the ball 101 and the ball holder 111 can be reduced, and therefore a ballpoint pen having excellent durability can be realized with less occurrence of degradation of writing performance of the ballpoint pen due to several uses thereof. Since improvement of the affinity between the ball 101 and ink provides a stable ink supply, stable writing and drawing can be realized with less unevenness in, e.g., color density of ink and width of a stroke of the ballpoint pen. Ink for a ballpoint pen can be classified into water-based ink, water-based gel ink, and oil-based ink. The oil-based ink for the ballpoint pen typically contains a solvent having a component with hydrophilic functional groups, such as an alcohol solvent or a glycol ether solvent. The carbon-oxygen bonds in the carbonaceous film 103 also allow improvement of the durability and the usability not only for the water-based ink and the water-based gel ink, but also for the oil-based ink.

Figure 6:
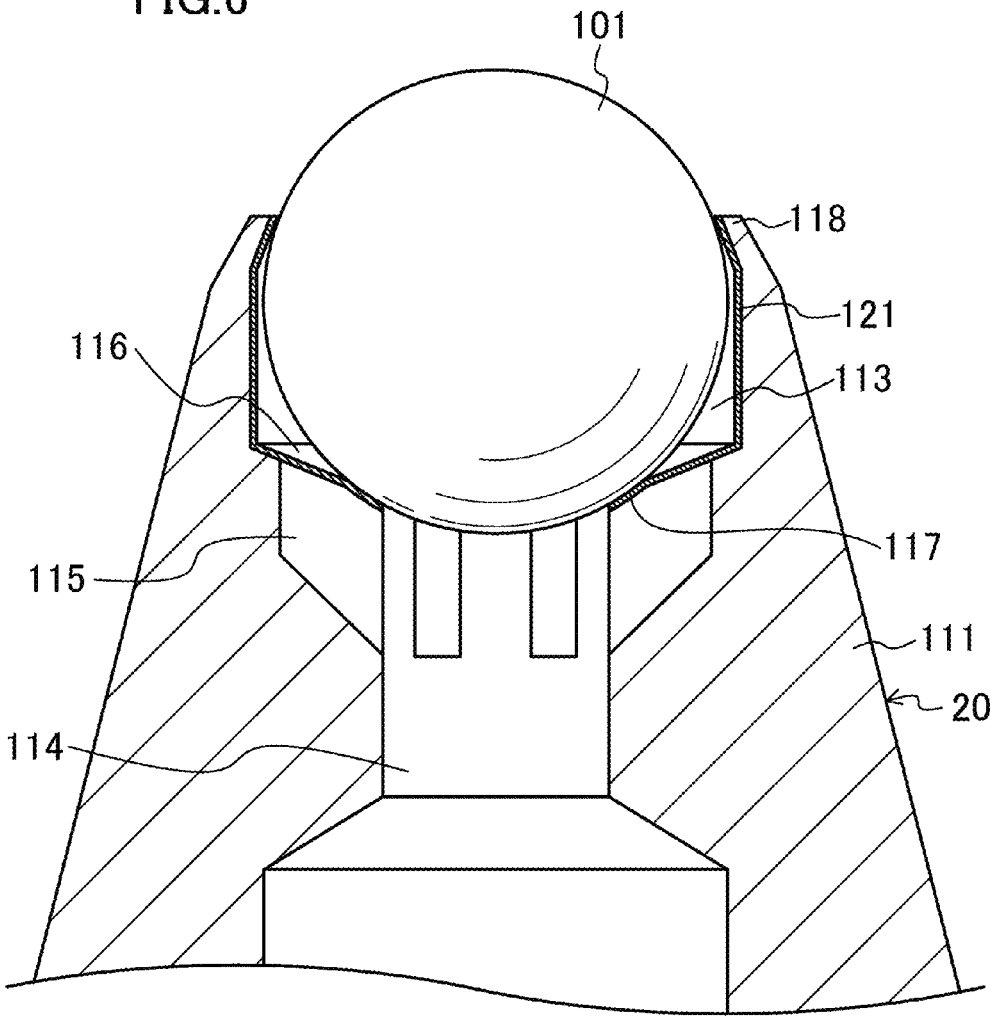
FIG. 6 is a cross-sectional view illustrating a main part of a variation of the ballpoint pen tip of the embodiment.

Since the ballpoint pen tip of the present embodiment has the high affinity between the ball 101 and ink, the abrasion of the ball 101 and the ball holder 111 can be reduced even if the ball holder 111 is made of a common material. The same carbonaceous film as that of the ball 101 is formed on at least part of the ball holder 111 contacting the ball 101, thereby further reducing the abrasion of the ball 101 and the ball holder 111. For example, a carbonaceous film is formed on a surface of the ball seat 117, thereby further reducing the abrasion of the ball 101 and the ball holder 111. Alternatively, as illustrated in FIG. 6, a carbonaceous film 121 may be formed so as to cover, e.g., a surface of the tip end edge part 118 and the bottom surface 116. As another alternative, a carbonaceous film may be formed on an outer surface of the ball holder 111. As still another alternative, a carbonaceous film may be formed on a surface of part of the ballpoint pen tip 20 other than ball holder 111. As still another alternative, if a carbonaceous film is formed on the ball holder 111, a common ball which is not covered with a carbonaceous film may be used.

The carbonaceous film 121 formed on the ball holder 111 and the carbonaceous film 103 formed at the surface of the ball body 102 may have the same amount of the formed functional groups. Alternatively, carbonaceous films having different amounts of the formed functional groups may be formed on the ball holder 111 and the ball body 102, respectively.

Next, the present disclosure will be described in more detail with reference to an example. Note that the present disclosure is not limited to the example described below, and various improvement and various changes in design may be performed as long as they do not depart from the sprit of the invention.

Method for Manufacturing Ball

Tungsten carbide (WC corresponding to ISO K-10) was used for a ball body. The diameter of the ball body was 0.5 or 0.7 mm. First, an intermediate layer (not shown in the figure) made of an amorphous film containing Si and C was formed on a surface of the ball body. Ionized deposition was used for the film formation. The pressure of a chamber for ionized deposition was adjusted to a predetermined pressure by using a vacuum pump, and tetramethylsilane ($Si(CH_3)_4$) was introduced into the chamber. Then, bias voltage of 1 kV was applied to the ball body, and electrical discharge was generated for 30 minutes. The ball body rotated in the chamber upon the film formation, thereby forming the intermediate layer on the entirety of the surface of the ball body.

After the intermediate layer was formed, a carbonaceous film was formed by using benzene as gas to be supplied to the chamber in the case where the carbonaceous film is made of DLC-1, or by using acetylene in the case where the carbonaceous film is made of DLC-2. In the case of DLC-1, after the pressure of the chamber was adjusted to the predetermined pressure by using the vacuum pump, bias voltage of 1 kV was applied to the ball body, and then electrical discharge was generated for 90 minutes. In the case of DLC-2, after electrical discharge was generated, the film formation using plasma generated by a high-frequency source further continues for 60 seconds under a pressure of 10 Pa. The ball body rotated in the chamber upon the film formation, thereby forming the carbonaceous film on the entirety of the surface of the ball body.

Subsequently, the carbonaceous film was irradiated with plasma of atmosphere containing oxygen, thereby forming carbon-oxygen bonds in the carbonaceous film. The plasma irradiation was performed under conditions where the pressure of the chamber was adjusted to a pressure of 100 Pa and an output from the high-frequency power source was 10 W in the case of DLC-1 or was 50 Win the case of DLC-2.

Method for Evaluating Carbonaceous Film

The composition of the obtained carbonaceous film was evaluated by an X-ray photoelectron spectroscopy (XPS) measurement. Conditions for the XPS measurement were as follows: a detection angle with a sample was 90°; Al was used as an X-ray source; and X-ray irradiation energy was 100 W. A time period for each measurement was 0.1 ms, and 64 measurements were performed for a single sample.

A carbon is (C1s) peak obtained by the XPS measurement was separated into the following seven compositions by curve fitting: $sp^3C$—C and $sp^2C$—C in each of which carbon atoms are bonded together; $sp^3C$—H and $sp^2C$—H in each of which carbon atoms and hydrogen atoms are bonded together; and C—O, C═O, and O═C—O in each of which carbon atoms and oxygen atoms are bonded together. The bonding energy for each composition was as follows: 283.8 eV for $sp^3C$—C, 284.3 eV for $sp^2C$—C, 284.8 eV for $sp^3C$—H, 285.3 eV for $sp^2C$—H, 285.9 eV for C—O; 287.3 eV for C═O; and 288.8 eV for O═C—O. A value obtained by dividing each peak area obtained by the curve fitting by the entire area of the C1s peak was a composition ratio of each composition. The sum of the composition ratios of C—O, C═O, and O═C—O was a ratio ($CO_{total}$) of carbon atoms forming the carbon-oxygen bonds to the total carbon atoms in the carbonaceous film.

The thickness of the carbonaceous film and the thickness of the intermediate film were measured based on the depth profile of the composition obtained by Auger electron spectroscopy (AES) analysis. In the AES analysis, acceleration voltage of an electron gun was 10 kV; sample current was 500 nA; and acceleration voltage of an argon ion gun was 2 kV. The analysis in the depth was performed for an area of 40 μm square.

An automatic contact angle meter (DM-500 manufactured by Kyowa Interface Science Co., Ltd.) was used for measurement of a contact angle. After ink of 1 μl was dropped onto a surface of the carbonaceous film, the contact angle was measured. Note that measurement timing in the case where water-based ink was dropped was right after the dropping, and measurement timing in the case where water-based gel ink or oil-based ink having high viscosity was dropped was after the lapse of 3 seconds after the dropping. A measurement value was an average of three repeats.

A zeta-potential and particle size analyzer (ELS-Z manufactured by Otsuka Electronics Co., Ltd.) was used for measurement of a zeta potential, and monitoring particles (manufactured by Otsuka Electronics Co., Ltd.) were used, which were dispersed in a sodium chloride (NaCl) solution of 10 mM. The monitoring particles at each level of a cell in the depth direction thereof were moved by electrophoresis, and an apparent velocity distribution in the cell was measured. The electrophoresis was caused under conditions where an average electrical field was 17.33 V/cm and average current was 1.02 mA. The obtained apparent velocity distribution was analyzed according to the Mori-Okamoto equation, thereby obtaining a surface potential of the carbonaceous film.

Method for Evaluating Durability

The ball provided with the carbonaceous film having the carbon-oxygen bonds was attached to a ball holder of a commercially-available ballpoint pen (manufactured by PILOT Corporation), and a durability evaluation test was performed. The material of the ball holder was ferrite stainless steel. The durability evaluation test is a test for examining a writing distance of a ballpoint pen by using a testing apparatus in which the ballpoint pen held so as to be inclined to a plane of paper at 70° rotates to draw a circle having a diameter of 32 mm and a writing paper (JIS P3201) is moved at a velocity of 4 m/minute. Every time the ballpoint pen draws a single circle, the writing distance of the ballpoint pen is increased by about 10 cm. A distance from the ball holder to a tip end position of the ball was measured once every 100 m of the writing distance. Since the distance from the ball holder to the tip end position of the ball is shortened due to abrasion of the ball and the ball holder, a change amount of the tip end position (an amount by which the tip end position was lowered) was regarded as an abrasion amount.

Evaluation Results

Figure 7:
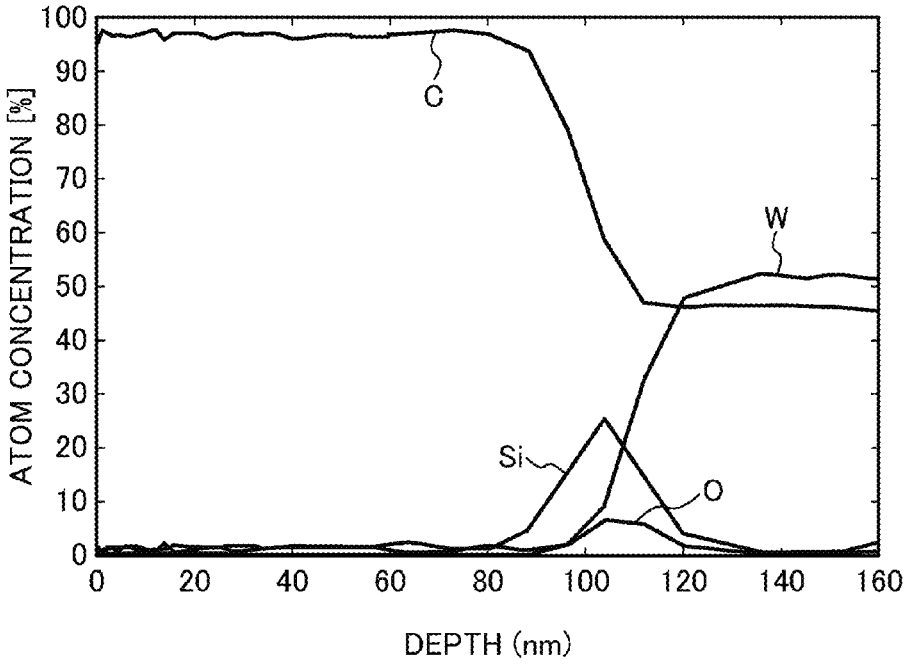
FIG. 7 illustrates results of elemental analysis in the depth of a ball provided with a carbonaceous film.

FIG. 7 illustrates results of the AES analysis of the ball provided with the carbonaceous film. It is obvious that only carbon atoms (C) are substantially present until the depth from the surface of the ball reaches about 80 nm and it means that the carbonaceous film is formed. It is also obvious that Si atoms are present at a depth of 80-120 nm and it means that the intermediate layer made of SiC is formed. The ball body made of tungsten carbide (WC) was detected in part of the ball at a depth of equal to or greater than about 100 nm.

Figures 8, 9:
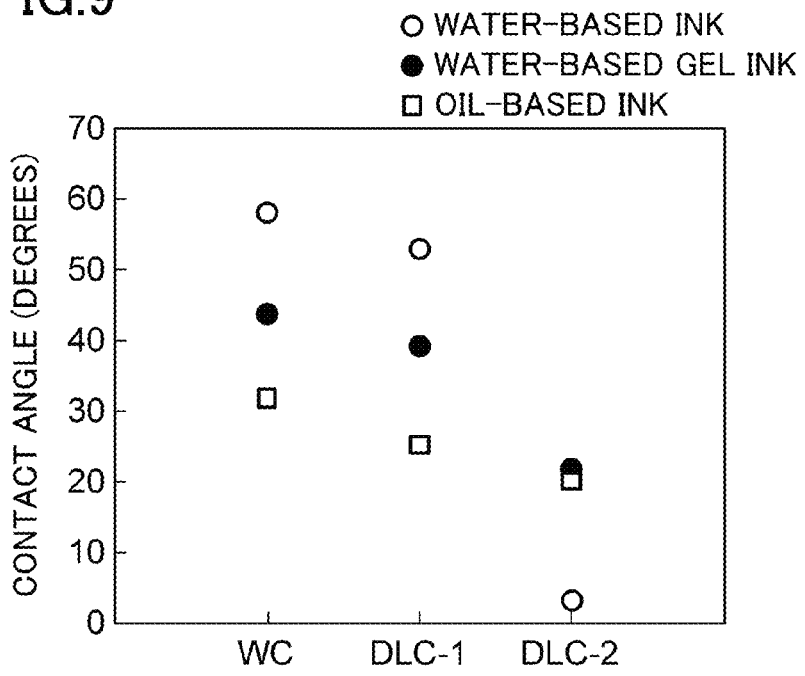
FIG. 8 illustrates specific examples of the carbonaceous film having oxygen atoms.
FIG. 9 illustrates measurement results of a contact angle of ink.

The carbonaceous film is irradiated with oxygen plasma, thereby forming the carbon-oxygen bonds at the surface of the carbonaceous film. By changing the plasma irradiation conditions, two types of carbonaceous films having different ratios of carbon atoms in the carbon-oxygen bonds were obtained as illustrated in FIG. 8. In FIG. 8, "C—C" represents the sum of $sp^3C$—C and $sp^2C$—C, and "C—H" represents the sum of $sp^3C$—H and $sp^2C$—H. In the case of DLC-1, the output from the high-frequency power source was 10 W, and the oxygen plasma irradiation was performed for 60 seconds. In the case of DLC-2, the output from the high-frequency power source was 50 W, and the oxygen plasma irradiation was performed for 60 seconds. The ratio ($CO_{total}$) of carbon atoms bonded to oxygen atoms to the total carbon atoms in the carbonaceous film is 0.16 in the case of DLC-1, and is 0.43 in the case of DLC-2. A value for the ratio $CO_{total}$ is larger in the case of DLC-2 for which the power source output was higher when the oxygen plasma irradiation was performed, than in the case of DLC-1. To describe the ratio $CO_{total}$ more specifically, the ratio of C—O to the total carbon atoms is substantially the same between the cases of DLC-1 and DLC-2. However, the ratio of C═O to the total carbon atoms is about six times larger in the case of DLC-2 than in the case of DLC-1, and the ratio of O═C—O to the total carbon atoms is about nine times larger in the case of DLC-2 than in the case of DLC-1.

Ink for a ballpoint pen mainly includes dye or pigment as a colorant and a solvent, and the water-based gel ink further includes a thickening agent. For the water-based ink and the water-based gel ink, water is mainly used as the solvent. Thus, the affinity between the carbonaceous film and ink is increased if the carbonaceous film has a certain degree of hydrophilic properties at the surface thereof. In addition, an organic solvent of the oil-based ink also has a component with hydrophilic functional groups, such as an alcohol solvent or a glycol ether solvent. Thus, the affinity between the carbonaceous film and ink is also increased if the carbonaceous film has a certain degree of hydrophilic properties at the surface thereof.

The composition C—O obtained by the XPS measurement mainly forms, e.g., hydroxyl groups and ether; the composition C═O mainly forms, e.g., carbonyl groups and ketone; and the composition O═C—O mainly forms, e.g., carboxyl groups and ester. Thus, an increase in value for $CO_{total}$ results in an increase in hydrophilic properties at the surface of the carbonaceous film, and, as a result, the affinity between the carbonaceous film and ink is increased. The value for $CO_{total}$ may be at least equal to or greater than 0.1. However, since a substantial increase in value for $CO_{total}$ results in weakening of bonding between carbon atoms and a decrease in hardness, the value for $CO_{total}$ is preferably equal to or less than 0.5.

FIG. 9 illustrates measurement results of the contact angle for the water-based ink, the water-based gel ink, and the oil-based ink. The used water-based ink is commercially-available ink (manufactured by PILOT Corporation) containing, e.g., an organic solvent, water, and a water-soluble dye colorant. The viscosity under a temperature of 20° C. is 1-2 mPa·S. The water-based gel ink is ink used for a commercially-available gel ink ballpoint pen (G-2 manufactured by PILOT Corporation). The water-based gel ink contains, e.g., an organic solvent, a water-soluble dye colorant, a shear-thinning viscosity providing agent, a moisturizing/wetting agent, and water. The viscosity at a shear velocity of 384.0 $second^{-1}$ under a temperature of 20° C. is 50 mPa·s. The oil-based ink is ink formed by reducing the viscosity of ink used for a commercially-available oil-based ink ballpoint pen (manufactured by PILOT Corporation). Since a lower viscosity oil-based ink results in more abrasion of a ball seat, the low-viscosity ink was used. The oil-based ink contains, e.g., phenyl glycol and benzene alcohol which are organic solvents, an oil-soluble dye colorant, resin, a lubricant, and a viscosity adjusting agent. The viscosity under a temperature of 20° C. is 1500 mPa·s. Note that a digital DV-II viscometer (CPE-42 rotor manufactured by Brookfield Corporation) was used for measurement of the viscosity.

As a control, measurement was also performed for a tungsten carbide (WC) ball on which a carbonaceous film is not formed. For any of the water-based ink, the water-based gel ink, and the oil-based ink, the contact angle with the carbonaceous film made of DLC-1 was smaller than the contact angle with the WC ball, and the contact angle with the carbonaceous film made of DLC-2 was much smaller than the contact angle with the WC ball. For the water-based ink, although the contact angle with the WC ball provided without the carbonaceous film was about 60°, the contact angle was reduced to about 55° in the case of DLC-1. The contact angle was reduced to about 3° in the case of DLC-2, and it shows that the affinity was significantly increased. For the water-based gal ink, although the contact angle with the WC ball provided without the carbonaceous film was about 44°, the contact angle was reduced to about 39° in the case of DLC-1 and was reduced to about 22° in the case of DLC-2. For the oil-based ink, although the contact angle with the WC ball provided without the carbonaceous film was about 32°, the contact angle was reduced to about 25° in the case of DLC-1 and was reduced to about 20° in the case of DLC-2. It is obvious that, for each ink, the affinity for ink is improved by forming the carbonaceous film having the carbon-oxygen bonds.

It is assumed that, when the carboxyl groups are formed by forming the carbon-oxygen bonds, the zeta potential at the surface of the carbonaceous film is reduced. The zeta potential in the case of DLC-1 was about −25 mV, and the zeta potential in the case of DLC-2 was equal to or less than about −50 mV. In the carbonaceous film having the carbon-oxygen bonds, the zeta potential is represented by a negative value and is represented by a lower value particularly in the carbonaceous film made of DLC-2 having a higher composition ratio of O═C—O. It shows that the carboxyl groups are formed at the surface of the carbonaceous film.

Figure 10:
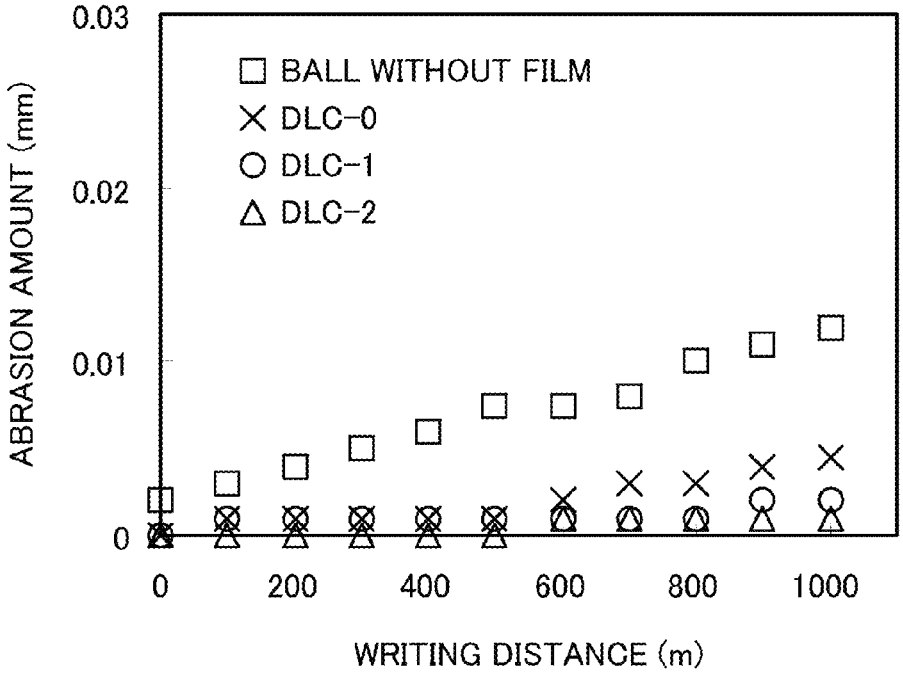
FIG. 10 illustrates results of a durability evaluation test when water-based gel ink is used.

FIG. 10 illustrates results of the durability evaluation test performed for water-based gel ink having the same composition as that used in the measurement of the contact angle. A ball of a ballpoint pen refill of a commercially-available water-based gel ink ballpoint pen (G-2 manufactured by PILOT Corporation) was replaced with a ball on which a carbonaceous film made of DLC-1 or DLC-2 is formed. An ink storage pipe was filled with water-based gel ink having the same composition as that used in the measurement of the contact angle. The diameter of the ball was 0.7 mm, and an average value was obtained after the measurement was performed for 10 ballpoint pens. A load to be applied to the ballpoint pen was 100 gf (about 0.98 N). In addition, as a control, the measurement was similarly performed for a ballpoint pen including a ball on which a DLC film (film made of DLC-0) which is not treated so as to have the functional groups is formed, and for a ballpoint pen including a ball on which a DLC film is not formed.

For the ball on which the carbonaceous film is not formed, it is recognized that an increase in writing distance resulted in an increase in abrasion amount and the abrasion amount was equal to or greater than 0.01 mm when the writing distance reached 1000 m. In addition, for the ball having the conventional DLC film (film made of DLC-0) which is not treated so as to have the functional groups at a surface thereof, it is recognized that, although the abrasion amount was stable at about 0.001 mm in the first half of the test, the abrasion amount was increased when the writing distance reached equal to or greater than 600 m. On the other hand, for the film made of DLC-1, little abrasion was occurred until the writing distance reached 800 m, and only an abrasion amount of about 0.001 mm was recognized when the writing distance reached 1000 m. For the film made of DLC-2, no abrasion was occurred. In general, it is assumed that a ball seat of a ball holder is most likely to be abraded and an abrasion amount (an amount by which a tip end position of a ball is lowered) is increased due to the abrasion of the ball seat. The following can be assumed regarding the water-based gel ink. The water-based gel ink is in a mixed lubrication state between the ball and the ball seat. In the cases of DLC-1 and DLC-2, the affinity between the ball and the water-based gel ink is improved. Thus, sufficient ink is held, e.g., between the ball and the ball seat, and it is less likely that the ball and the ball seat directly contact each other. As a result, it is less likely that the ball and the ball seat are abraded. In addition, in the case of DLC-2 having a higher affinity for the water-based gel ink, the abrasion amount is reduced more than that in the case of DLC-1.

Figure 11:
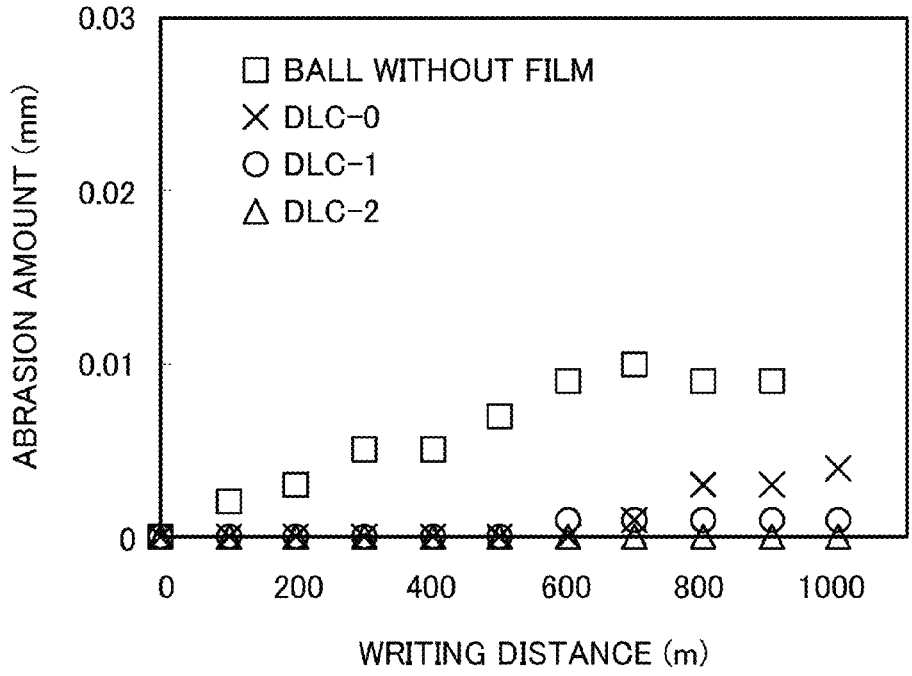
FIG. 11 illustrates results of the durability evaluation test when water-based gel ink is used.

FIG. 11 illustrates results of the durability evaluation test when the ball diameter is 0.5 mm. In such a case, a binder for the WC ball was changed from cobalt (Co) to nickel (Ni). The ball diameter was 0.5 mm, and an average value was obtained after the measurement was performed for 10 ballpoint pens formed in the same manner as that in the case where the ball diameter is 0.7 mm. A load to be applied to the ballpoint pen was 100 gf (about 0.98N). As in the case where the ball diameter is 0.7 mm, an increase in writing distance resulted in an increase in abrasion amount, and the abrasion amount was about 0.01 mm when the writing distance reached 900 m. In addition, for the ball having the conventional DLC film (film made of DLC-0) which is not treated so as to have the functional groups at the surface thereof, it is recognized that no abrasion was occurred in the first half of the test and the abrasion amount was increased after the writing distance reached 700 m. On the other hand, for the film made of DLC-1, no abrasion was occurred until the writing distance reached 500 m, and the abrasion amount was equal to or less than 0.001 mm when the writing distance reached 1000 m. In addition, for the film made of DLC-2, little abrasion was occurred when the writing distance reached 1000 m. As in the case where the ball diameter is 0.7 mm, the affinity between the ball and ink is improved. Thus, sufficient ink is held, e.g., between the ball and the ball seat, and it is less likely that the ball and the ball seat directly contact each other. As a result, it is less likely that the ball and the ball seat are abraded. In addition, in the case of DLC-2 having a higher affinity for the water-based gel ink, the abrasion amount is reduced more than that in the case of DLC-1.

Figure 12:
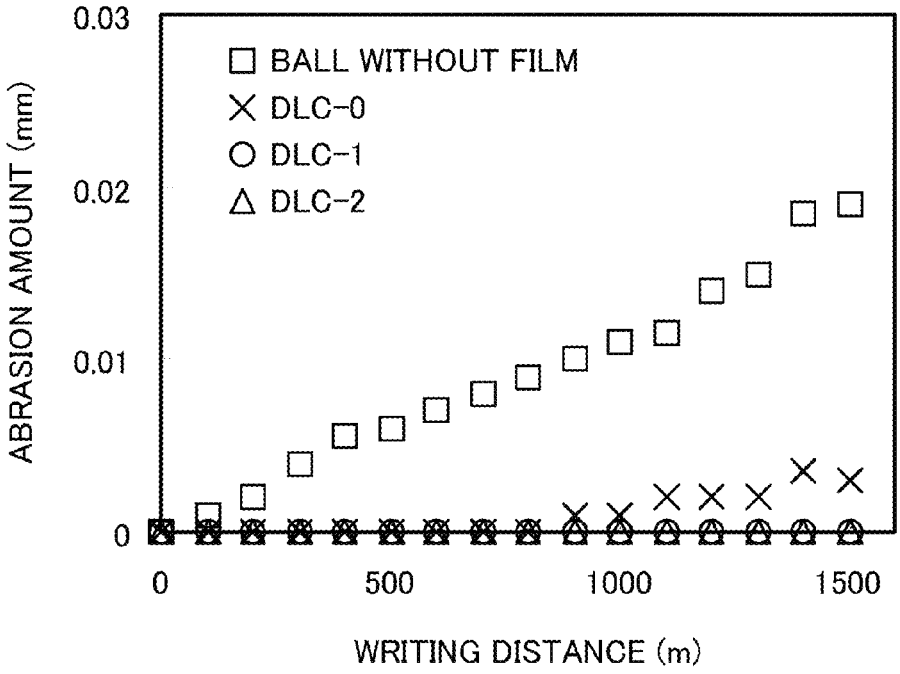
FIG. 12 illustrates results of the durability evaluation test when oil-based ink is used.

FIG. 12 illustrates results of the durability evaluation test performed for oil-based ink having the same composition as that used in the measurement of the contact angle. The ball diameter was 0.5 mm, and an average value was obtained after the measurement was performed for 10 ballpoint pens formed in the same manner as that in the case of the water-based gel ink. An ink storage pipe was filled with the oil-based ink having the same composition as that used in the measurement of the contact angle. Since writing pressure applied to the oil-based ink ballpoint pen is high, a load to be applied to the ballpoint pen was 400 gf (about 3.92 N). For the ball on which the carbonaceous film does not formed, an increase in writing distance resulted in an increase in abrasion amount as in the case of the water-based gel ink. The abrasion amount was about 0.01 mm when the writing distance reached 1000 m, and was about 0.02 mm when the writing distance reached 1500 m. For the ball provided with the conventional DLC film (film made of DLC-0) which is not treated so as to have the functional groups at the surface thereof, it is recognized that no abrasion was occurred in the first half of the test and the abrasion amount was increased after the writing distance reached 900 m. On the other hand, for the film made of DLC-1 or DLC-2, little abrasion was occurred when the writing distance reached 1500 m. In general, oil-based ink is in a fluid lubrication state between a ball and a ball seat. However, since the oil-based ink has the low viscosity, the oil-based ink is in the mixed lubrication state. In the cases of DLC-1 and DLC-2, the affinity between the ball and the oil-based ink is improved. Thus, sufficient ink is held, e.g., between the ball and the ball seat, and it is less likely that the ball and the ball seat directly contact each other. As a result, it is less likely that the ball and the ball seat are abraded. As described above, the durability was significantly improved not only for the water-based gel ink but also for the oil-based ink. Note that, e.g., the magnitude of the load to be applied to the ballpoint pen is one of factors that the abrasion amount of the ball seat is larger for the oil-based ink than for the water-based gel ink.

Figure 13:
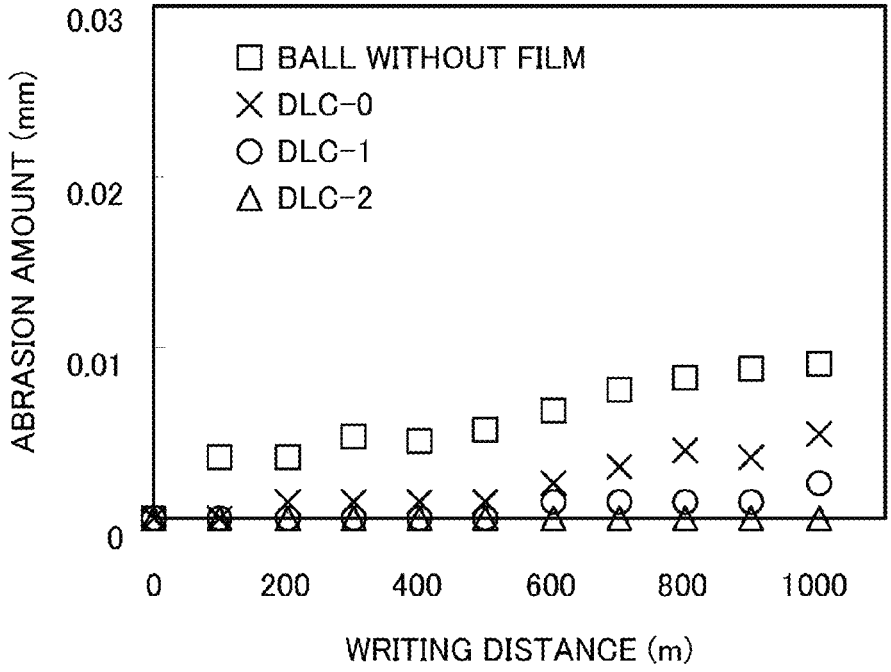
FIG. 13 illustrates results of the durability evaluation test when water-based ink is used.

FIG. 13 illustrates results of the durability evaluation test performed for water-based ink having the same composition as that used in the measurement of the contact angle. The ball diameter was 0.5 mm, and an average value was obtained after the measurement was performed for 10 ballpoint pens formed in the same manner as that in the case of the water-based gel ink. An ink storage pipe was filled with the water-based ink having the same composition as that used in the measurement of the contact angle. A load to be applied to the ballpoint pen was 100 gf (about 0.98 N). For the ball on which the carbonaceous film does not formed, an increase in writing distance also resulted in an increase in abrasion amount in the case of the water-based ink. The abrasion amount was about 0.01 mm when the writing distance reached 1000 m. For the ball having the conventional DLC film (film made of DLC-0) which is not treated so as to have the functional groups at the surface thereof, no abrasion was occurred in the first half of the test. In addition, abrasion started to occur after the writing distance reached 200 m, and the abrasion amount was increased after the writing distance reached 600 m. On the other hand, for the film made of DLC-1, the abrasion amount was about 0.001 mm when the writing distance reached 600 m and was about 0.002 mm when the writing distance reached 1000 m. For the film made of DLC-2, little abrasion was occurred when the writing distance reached 1000 m. It is assumed that the water-based ink is also in the mixed lubrication state between the ball and the ball seat. If the carbonaceous film having the carbon-oxygen bonds is formed, the affinity between the ball and the water-based ink is improved, and therefore it is less likely that the ball and the ball seat directly contact each other. As a result, it is less likely that the ball and the ball seat are abraded.

Note that wear resistance is further improved by forming the carbonaceous film not only on the surface of the ball but also on the surface of the ballpoint pen tip. In such a case, the carbonaceous film may be formed so as to cover at least part of the ball holder contacting the ball. The carbonaceous film formed on the surface of the ballpoint pen tip and the carbonaceous film formed on the surface of the ball may be the same or different from each other in, e.g., the amount of the formed functional groups and the value for $CO_{total}$. In addition, if the carbonaceous film is formed on the surface of the ballpoint pen tip, an intermediate layer may be formed between the carbonaceous film and the ballpoint pen tip.

For example, in the same manner as the durability evaluation test performed for the oil-based ink as illustrated in FIG. 12, a carbonaceous film having the same composition as that of the carbonaceous film made of DLC-1 was formed on the surface of the ballpoint pen tip, and the durability evaluation test was performed for 10 ballpoint pens to each of which a ball provided with the carbonaceous film made of DLC-1 or DLC-2 is attached. In such a case, for any of the ball provided with the carbonaceous film made of DLC-1 and the ball provided with the carbonaceous film made of DLC-2, little abrasion was occurred when the writing distance reached 1000 m. In addition, in the case where a carbonaceous film having the same composition as that of the carbonaceous film made of DLC-2 is formed on the surface of the ballpoint pen tip, little abrasion was occurred for any of the ball provided with the carbonaceous film made of DLC-1 and the ball provided with the carbonaceous film made of DLC-2 when the writing distance reached 1000 m.

Figure 14:
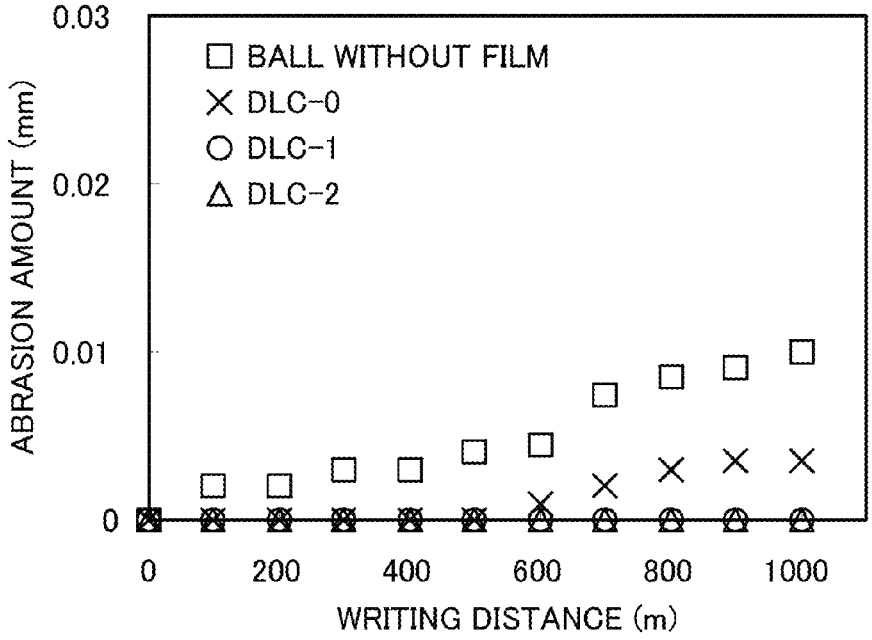
FIG. 14 illustrates results of the durability evaluation test when a carbonaceous film is formed on a ball holder.

If a carbonaceous film is formed on a ball holder, a ball which is not covered with a carbonaceous film may be used. FIG. 14 illustrates results of the durability evaluation test when the ball is a common ball which is not covered with a carbonaceous film and a carbonaceous film is formed on a surface of a ballpoint pen tip. Ball holders on which a carbonaceous film made of conventional DLC (DLC-0), a carbonaceous film made of DLC-1, and a carbonaceous film made of DLC-2 are respectively formed such that each of the carbonaceous films covers, e.g., a tip end edge part 118, a bottom surface 116, and a ball seat 117 of a ball holder 111 as illustrated in FIG. 6. The ball was a common WC ball using cobalt as a binder and having a diameter of 0.5 mm. An average value was obtained after the measurement was performed for 10 ballpoint pen refills each including an ink storage pipe filled with oil-based ink having the same composition as that used in the measurement of the contact angle. A load to be applied to the ballpoint pen was 400 gf (about 3.92 N).

As illustrated in FIG. 14, in the case where the carbonaceous film made of DLC-1 or DLC-2 is formed on the ball holder, little abrasion was occurred when the writing distance reached 1000 m as in the case where the carbonaceous film made of DLC-1 or DLC-2 is formed on the ball. On the other hand, in the case where the carbonaceous film is not formed on the ball holder or the case where the conventional carbonaceous film made of DLC-0 is formed on the ball holder, the abrasion was occurred by 0.01-0.005 mm in association with an increase in writing distance.

The results of the durability evaluation test as illustrated in FIGS. 10-13 show that slight abrasion is occurred in the case where the carbonaceous film made of DLC-1 or DLC-2 is formed. The inventors of the present invention have found that the occurrence of the slight abrasion in the case where the carbonaceous film made of DLC-1 or DLC-2 is formed is susceptible to surface roughness of the ball body before the carbonaceous film is formed.

FIG. 15 illustrates results of the durability evaluation test performed for water-based gel ink in a state in which a carbonaceous film made of DLC-1 is formed on a surface of each of WC balls having different arithmetic average roughness values (Ra). In the results of the durability evaluation test, a double circle indicates that no abrasion was occurred, and a circle indicates that slight abrasion was occurred by about 0.003 mm. In the case where the carbonaceous film made of DLC-1 is formed on the ball body having Ra of 3 nm, no abrasion was occurred even when the writing distance reached 1000 m. On the other hand, in the case where the carbonaceous film made of DLC-1 is formed on the ball body having Ra of equal to or greater than 3 nm, abrasion was occurred by about 0.003 mm when the writing distance reached 1000 m. As illustrated in FIG. 16, in the case where the diameter of the ball body is 0.7 mm, results similar to those in the case where the diameter of the ball body is 0.5 mm were obtained. In addition, as illustrated in FIGS. 17 and 18, the similar results were obtained for the oil-based ink. Since the results of the durability evaluation test for the water-based ink and the water-based gel ink are not significantly different from each other, the similar results may be also obtained for the water-based ink. In addition, although a difference in abrasion amount is smaller, the similar results may be also obtained in the case of DLC-2. As described above, Ra of the ball body on which the DLC film with the functional groups is formed is less than 3 nm, thereby further reducing the abrasion amount. Note that a commercially-available WC ball (manufactured by Tsubaki Nakashima Co., Ltd.) was used as the ball body and the Ra values were determined with reference to a list attached to a product. In addition, the similar results were obtained not only in the case where the ball body is the WC ball, but also in the case where the ball body is a ball made of, e.g., ceramics or stainless steel.

In the ballpoint pen tip and the ballpoint pen of the present disclosure, it is less likely that the ball and the ball holder are abraded and good writing characteristics can be exhibited for a long period of time. Thus, the ballpoint pen tip and the ballpoint pen of the present disclosure are useful as, e.g., ballpoint pen tips and ballpoint pens.

What is claimed is:

1. A ballpoint pen tip, comprising:

a ball including a ball body and a carbonaceous film covering a surface of the ball body; and a ball holder configured to rotatably hold the ball, wherein the carbonaceous film has carbon atoms and oxygen atoms bonded to some of the carbon atoms, and a ratio of carbon atoms bonded to oxygen atoms to a total carbon atoms at a surface of the carbonaceous film is equal to or greater than 0.1.

2. The ballpoint pen tip of claim 1, wherein the carbonaceous film has a zeta potential of equal to or less than −25 mV at the surface thereof.

3. The ballpoint pen tip of claim 1, wherein a ratio of $sp^3$-carbon-carbon bonds to $sp^2$-carbon-carbon bonds in the carbonaceous film is equal to or greater than 0.3.

4. The ballpoint pen tip of claim 1, wherein the ball includes an intermediate layer formed between the ball body and the carbonaceous film, and the intermediate layer contains carbon and silicon.

5. The ballpoint pen tip of claim 1, wherein an arithmetic average roughness at the surface of the ball body is equal to or less than 3 nm.

6. The ballpoint pen tip of claim 1, wherein the ball holder includes a carbonaceous film covering at least part of the ball holder contacting the ball.

7. A ballpoint pen, comprising:

the ballpoint pen tip of claim 1; and an ink storage pipe filled with ink, wherein a contact angle of the ink with the carbonaceous film is equal to or less than 55°.

8. A ballpoint pen tip, comprising:

a ball; and a ball holder configured to rotatably hold the ball, wherein the ball holder includes a carbonaceous film covering at least part of the ball holder contacting the ball, the carbonaceous film contains carbon atoms and oxygen atoms bonded to some of the carbon atoms, and a ratio of carbon atoms bonded to oxygen atoms to a total carbon atoms at a surface of the carbonaceous film is equal to or greater than 0.1.

9. The ballpoint pen tip of claim 8, wherein the carbonaceous film has a zeta potential of equal to or less than −25 mV at the surface thereof.

10. The ballpoint pen tip of claim 8, wherein a ratio of $sp^3$-carbon-carbon bonds to $sp^2$-carbon-carbon bonds in the carbonaceous film is equal to or greater than 0.3.

11. The ballpoint pen tip of claim 8, wherein the carbonaceous film is formed on a surface of the ball holder with an intermediate layer being interposed therebetween, and the intermediate layer contains carbon and silicon.

12. A ballpoint pen, comprising:

the ballpoint pen tip of claim 8; and an ink storage pipe filled with ink, wherein a contact angle of the ink with the carbonaceous film is equal to or less than 55°.

* * * * *